US007029768B1

(12) United States Patent
Ohmori et al.

(10) Patent No.: US 7,029,768 B1
(45) Date of Patent: Apr. 18, 2006

(54) FOOD CONTAINER USING TITANIUM OXIDE PARTICLE AND PRODUCTION METHOD THEREOF

(75) Inventors: Masahiro Ohmori, Chiba (JP); Takashi Ohkubo, Chiba (JP); Masayuki Sanbayashi, Chiba (JP)

(73) Assignee: Showa Denko Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/457,696

(22) Filed: Dec. 9, 1999

Related U.S. Application Data

(60) Provisional application No. 60/166,756, filed on Nov. 22, 1999, provisional application No. 60/136,231, filed on May 26, 1999.

(30) Foreign Application Priority Data

Dec. 9, 1998 (JP) ..... 10-350406
Oct. 6, 1999 (JP) ..... 11-286114

(51) Int. Cl.
*B32B 19/00* (2006.01)

(52) U.S. Cl. ..... 428/702; 428/432; 428/34.1; 427/239; 427/453; 427/181

(58) Field of Classification Search ..... 423/210, 423/245.1, 245.3; 204/247, 157.4 H, 157.63; 588/227; 428/701, 432, 472, 34.1, 702; 427/585, 427/453, 236, 237, 239, 181
See application file for complete search history.

(56) References Cited

U.S. PATENT DOCUMENTS

| | | | | |
|---|---|---|---|---|
| 4,321,224 | A * | 3/1982 | Shimizu et al. | 264/115 |
| 4,814,318 | A * | 3/1989 | Hums | 502/439 |
| 5,853,866 | A | 12/1998 | Watanabe et al. | |
| 5,874,701 | A * | 2/1999 | Watanabe et al. | 204/157.15 |
| 5,897,958 | A * | 4/1999 | Yamada et al. | 446/474 |
| 5,910,560 | A | 6/1999 | Nagashima et al. | |
| 5,943,950 | A | 8/1999 | Taoda et al. | |
| 6,027,766 | A * | 2/2000 | Greenberg et al. | 427/226 |
| 6,054,227 | A * | 4/2000 | Greenberg et al. | 428/701 |
| 6,210,779 | B1 * | 4/2001 | Watanabe et al. | 428/208 |

FOREIGN PATENT DOCUMENTS

| | | | |
|---|---|---|---|
| EP | 0 826 633 A1 | * | 4/1998 |
| EP | 1 083 152 A1 | | 3/2001 |
| JP | 410259325 A | * | 9/1998 |
| WO | 99/58451 | * | 11/1999 |
| WO | WO 99/58451 A1 | | 11/1999 |

* cited by examiner

*Primary Examiner*—Michael C. Miggins
(74) *Attorney, Agent, or Firm*—Sughrue Mion, PLLC

(57) ABSTRACT

A food container on which surface titanium oxide particles are fixed, where titanium oxide particles may contain brookite crystals, the material of which the food container is constructed may be stainless steel, and the titanium oxide particles may be bonded using a sintering aid, a binder or both. When the food container is made of glass, satisfactory mechanical strength of the container can be maintained even when the thickness of a wall of the container is reduced. Since titanium oxide particles can be fixed onto a surface of a food container at a temperature as low as 20 to 450° C. by use of a sintering aid, a binder or both thermal deformation of glass forming the food container can be prevented.

12 Claims, No Drawings

FOOD CONTAINER USING TITANIUM OXIDE PARTICLE AND PRODUCTION METHOD THEREOF

CROSS REFERENCE TO RELATED APPLICATIONS

This application is an application filed under 35 U.S.C. §111(a) claiming benefit pursuant to 35 U.S.C. §119(e)(i) of the filing date of Provisional Application No. 60/136,231 filed May 26, 1999 and Provisional Application No. 60/166,756 filed Nov. 22, 1999 pursuant to 35 U.S.C. §111(b).

FIELD OF THE INVENTION

The present invention relates to a food container using titanium oxide particles. More specifically, the present invention provides a food container which is soil-resistant and can be easily washed when soiled. Furthermore, when the container is made of glass, the mechanical strength of the container can be enhanced. The invention ensures duration of such effects over a long period of time. The food as used herein includes drinks such as beer.

BACKGROUND OF THE INVENTION

As a food container such as barrel or tank for transporting or storing drinks (for example, beer, juice and milk) or liquid foods or as a food container such as a large tank used in a tank truck, a container made of glass, plastic, metal or the like is employed depending on the use purpose. Among these, a metal container is widely used because of its excellent durability. In particular, a stainless steel container is used for general purposes because it is resistant to rusting. In the meantime, a glass container serves as a convenient container in view of advantages such as freedom in shaping and low cost.

Containers for transportation or storage are repeatedly used in many cases and are used outdoors on many occasions. Therefore, containers where the outside or filling port is difficult to soil and even when soiled, can be easily washed are required. Glass containers have a thick-wall structure to compensate for its weak mechanical strength, as compared with the case of a stainless steel container, and therefore are heavier as much. Accordingly, there is a need for reducing the weight of glass containers.

To ensure the food container is difficult to soil, a surface treatment method such as a method of treating the container surface with fluorine, for example, by coating a fluororesin thereon to enlarge the contact angle with water, namely, improve the water repellency, is known.

However, in treating the surface of a food container, for example, by coating a fluororesin thereon, the color of the coating agent used adversely affects the color of the food container. Therefore, this is disadvantageous as a surface treatment method of food containers where the feel of cleanliness is needed. Furthermore, the coating may be abraded or peeled off during use and there is a problem in the use of container over a long period of time.

In addition, the mechanical strength of a food container made of glass disadvantageously decreases when the thickness of a wall of the container is reduced in order to reduce the weight of the container.

SUMMARY OF THE INVENTION

The present invention has been made under these circumstances and an object of the present invention is to provide a food container which is difficult to soil, can be easily washed even when soiled and ensures the effect is durable over a long period of time. Particularly, when the food container is made of glass, another object of the invention is to provide a satisfactory mechanical strength of the container even when the thickness of the wall of the container is reduced.

The objects of the present invention are attained by a food container having on a surface thereof titanium oxide particles. The titanium oxide particles preferably contain brookite crystals and the material of which the food container is constructed is preferably stainless steel or glass.

The titanium oxide particles are preferably caused to be present on a surface of the food container using a binder and/or a sintering aid.

Preferably, the titanium oxide particles are caused to be present on a surface of the food container by use of a binder and/or a sintering aid and fixed at 20 to 450° C.

The present invention provides a method for producing a food container comprising fixing titanium oxide to a surface thereof by use of a binder and/or a sintering aid.

The present invention provides a method for producing a food container which process comprises fixing titanium oxide particles to be present on a surface thereof by use of a binder and/or a sintering aid and fixing the particles at 20 to 450° C.

DETAILED DESCRIPTION OF THE INVENTION

The present invention is described in detail below.

The food container for use in the present invention is not particularly limited as long as it is used for transportation, storage or the like of food or drink. Examples thereof include containers such as bottles, barrels, and tanks for the transportation of drinks like beer, juice and milk, and large tanks for use in a tank truck. The material of which these containers are constructed is not particularly limited as long as it is suitable in view of safety and hygiene. Generally, glass, plastic, metal, and the like are used. However, the container is transported or repeatedly used, therefore, a metal or glass having excellent durability is preferably used and stainless steel difficult to rust is more preferably used as a metal.

These food containers are used outdoors in many cases and have a filling port in a complicated uneven shape like a stainless steel-made beer barrel or a returnable glass bottle made of a glass material such as soda-lime glass or borosilicate glass, where the barrel or bottle is easy to soil and difficult to wash.

The titanium oxide particles for use in the present invention have a photocatalytic function of degrading organic material and the like using an ultraviolet light, to thereby provide effects such as decomposition of organic materials like soil originating in food, sterilization and inhibition of molds. Furthermore, the titanium oxide particles have high hydrophilicity, therefore, can prevent adhering of an organic material such as oil originated in food, or attachment of inorganic dust or silt. When titanium oxide particles are applied to the surface of a glass container, the mechanical strength of the container increases, to thereby enable the thickness of a wall of the container to be reduced, leading to a reduction of the overall weight of the glass container.

The crystal structure of such titanium oxide particles is not particularly limited. In general, tetragonal low temperature-type anatase, high temperature-type rutile, and rhombic brookite titanium oxide particles are used, and titanium oxide particles containing brookite titanium oxide particles are preferably used. The titanium oxide particles containing brookite crystal may be brookite titanium oxide particles alone or may contain rutile or anatase titanium oxide particles. In the case of rutile or anatase titanium oxide particles, the proportion of the brookite titanium oxide particles in the titanium oxide particles is not particularly limited but it is usually from 1 to 100 wt %, preferably from 10 to 100 wt %, more preferably from 50 to 100 wt %. This is because brookite titanium oxide has superior photocatalytic activity to rutile or anatase titanium oxide.

Titanium oxide particles containing brookite crystals may be produced by a production method in the gaseous phase where anatase titanium oxide particles are heat-treated to obtain titanium oxide particles containing brookite crystals, or by a production method in the liquid phase where a titanium compound such as titanium tetrachloride, titanium trichloride, titanium alkoxide, or titanium sulfate is neutralized or hydrolyzed to obtain a titanium oxide sol in which titanium oxide particles are dispersed.

These production methods are not particularly limited as long as titanium oxide particles containing brookite crystals can be obtained. However, on taking account of photocatalytic activity of the substance obtained, easy handleability and when titanium oxide film is formed, transparency, adhesion, and hardness of the film, the method described in the examples of the present invention is preferred. More specifically, the titanium oxide particles containing brookite crystals are preferably produced by a method of adding titanium tetrachloride to hot water at from 75 to 100° C. and hydrolyzing the titanium tetrachloride at a temperature of from 75° C. to the boiling point of the solution while controlling the chloride ion concentration to obtain titanium oxide particles containing brookite crystals as a titanium oxide sol or by a method of adding titanium tetrachloride to hot water at from 75 to 100° C. and hydrolyzing the titanium tetrachloride in the presence of either one or both of nitrate ions and phosphate ions at a temperature of from 75° C. to the boiling point of the solution while controlling the total concentration of chloride ion, nitrate ion, and phosphate ion to obtain titanium oxide particles containing brookite crystals as a titanium oxide sol.

The size of the titanium oxide particles is not particularly limited but the average particle size is usually from 0.005 to 0.1 μm. If the average particle size exceeds 0.1 μm, the photocatalytic activity decreases and there is difficulty in attaining the effect such that the food container produced is difficult to soil and even when soiled, the organic material can be easily degraded, thereby cleaning the container. Furthermore, the transparency of the titanium oxide particles decreases and in the case of a food container having such titanium oxide particles on a surface thereof, the color of the titanium oxide particles adversely affects the color of the food container and this is not preferred. If the average particle size is less than 0.005 μm, the titanium oxide particles are difficult to handle in production. The specific surface area of the titanium oxide particles is usually 20 $m^2/g$ or more.

The thus-obtained titanium oxide particles may be caused to be present or adhered on a surface of a food container by a method of applying the titanium oxide particle sol on the food container and then subjecting it to drying, heat treatment, sintering or the like, thereby fixing the particles to the surface of the container, or by a method of mixing titanium oxide particles with a coating material or the like, applying the mixture on the food container, and then subjecting it to drying and heat treatment. Alternatively, the titanium oxide particles may be directly fixed onto the food container using a binder or the like.

If the pH of the titanium oxide particle sol is less than 1, a food container made of a metal such as stainless steel may be corroded. Therefore, the pH is preferably controlled to 1 or more by filtration washing, electrodialysis, ion exchanging, electrolysis, or the like.

The method for coating titanium oxide particles to a food container is not particularly limited and any known method such as spin coating, flow coating, dip coating, spray coating, bar coating, roller coating, brush coating, or dip coating may be used. The amount of titanium oxide coated is usually from 0.01 to 100 μm in terms of the thickness of the coated film.

In the case where a titanium oxide particle sol is applied to a food container and then fixed to a surface by drying, heat treatment, sintering, or the like, a sintering aid, binder, or binder precursor may be added to the titanium oxide sol. An undercoat treatment of previously applying a binder to a food container to form an undercoat layer may also be used. The sintering aid or binder is used for enhancing the adhesion strength between the titanium oxide particles and the food container and further improving the film hardness. By adding a sintering aid or a binder as such, the titanium oxide particles do not easily fall off the food container and the effect continues for a long period of time, such that the food container produced is difficult to soil and even when soiled, the soil can be easily removed.

The kind of the sintering aid, binder, or binder precursor varies depending on the material of which the food container is constructed. However, the sintering aid is not particularly limited as long as it is a Broensted acid. Examples thereof include phosphoric acid, hydrochloric acid, and organic carboxylic acids such as acetic acid. Examples of binders include metal oxides such as silicon oxide, titanium oxide, aluminum oxide, zirconium oxide, calcium oxide, and magnesium oxide. The binder precursor is preferably an alkoxide of the above-described metals because the adhesive property or film strength can be increased, more preferably phosphoric acid as a sintering aid, silicon alkoxide as a binder precursor such as tetramethoxysilane or tetraethoxysilane, titanium alkoxide, titanium acetate, or a titanium chelate as a binder. Silicon alkoxides such as tetramethoxysilane and tetraethoxysilane are condensed to form polysiloxane or organopolysiloxane to serve as a binder.

The surface of titanium oxide particles in air is covered with oxygen or a hydroxyl group. Therefore, when phosphoric acid, a silicon oxide forming a silanol bond, a silicon oxide precursor, titanium oxide, or a titanium oxide precursor is used, the sintering aid or binder is condensed with and firmly bonded to the respective surfaces of the food container and the titanium oxide particles, as a result, excellent adhesion strength is achieved with a small amount. Even if the food container is made of a metal, a metal oxide layer is substantially present on the surface and therefore, strong adhesion to the binder is attained. In the case where the material of which the container is constructed is stainless steel, phosphoric acid as a sintering aid is preferably used. In the case where the material of which the container is constructed is glass, silicon alkoxides such as tetramethoxysilane and tetraethoxysilane are preferably used as binder precursors.

The titanium oxide thin film formed using such a sintering aid, binder, or binder precursor has a hardness of, when phosphoric acid is used, 4H or more as a pencil hardness and when silicon oxide, titanium oxide, or a precursor thereof is used, 6H or more as a pencil hardness, even though the hardness varies depending on the material of the container. Because of such high film strength, the titanium oxide film is not easily peeled off.

The above-described sintering aids or binders may be used either individually or in combination of two or more thereof. When a mixture thereof is used, the mixing ratio may be freely selected. In the case of adding a sintering aid, the amount added thereof is usually from 10 to 10,000 ppm based on the titanium oxide. If the amount added exceeds 10,000 ppm, sintering must be performed at a high temperature and disadvantageously takes a long time, whereas if it is less than 10 ppm, the sintering effect is insufficient and this is disadvantageous. In the case of adding a binder or binder precursor, the amount added thereof is usually, calculated in terms of an oxide, from 5 to 50 wt % based on the titanium oxide. If the amount added exceeds 50 wt %, titanium oxide particles are buried in the binder in a large proportion and the photocatalytic activity of the coated film decreases, whereas if it is less than 5 wt %, the effect of the binder is not attained and this is not preferred.

The method for adding a sintering aid, a binder, or a binder precursor is not particularly limited but they may be added by a method of adding to a titanium oxide sol and applying the sol to a food container or by a method of applying a sintering aid, a binder, or a binder precursor by use of another spray during spray coating of a titanium oxide sol.

In the case where a titanium oxide sol is applied to a food container and then dried, an appropriate solvent may be added to increase the drying rate. In general, when the titanium oxide sol is a water dispersion, an organic solvent such as ethyl alcohol is used.

Also, before application of the titanium oxide particle sol to a food container, a solution containing silica or fluororesin may be applied to a surface of the food container and dried to form a protective film, so that deterioration of the food container due to titanium oxide can be prevented.

The thus-applied titanium oxide particle sol is then subjected to drying, heat treatment, or the like so as to fix the titanium oxide particles to the food container. The atmosphere at drying or heat treatment is not particularly limited and it may be performed in air, in a vacuum, or in an inert gas atmosphere. Generally, the drying or heat treatment is performed in air. The drying or heat treatment temperature varies depending on the kind of the sintering aid, binder, or binder precursor, however, it is usually from 20 to 800° C. When a sintering aid, binder, or binder precursor is used, the temperature is typically from 20 to 450° C. Drying time or heat treatment time is usually from 5 minutes to 24 hours, preferably from 15 minutes to 12 hours.

For example, in the case where the material of which the food container is constructed is stainless steel or glass, treatment is performed at 100 to 450° C. by use of phosphoric acid serving as a sintering aid or at 20 to 450° C. by use of silicon oxide as serving as a binder or a binder precursor such as tetramethoxysilane, tetraethoxysilane, titanium alkoxide, titanium chelate, or titanium acetate, to thereby advantageously enhance the strength of the film formed from titanium oxide particles. Similarly, the heat treatment time is usually from 5 minutes to 24 hours, preferably from 15 minutes to 12 hours.

Thus, use of a sintering aid, binder, or binder precursor enables the titanium oxide particles to be fixed onto a surface of a container at a temperature as low as 20 to 450° C., to thereby reduce energy cost for heat treatment. In addition, when a food container is made of glass, titanium oxide particles can be fixed onto the surface of a container at a temperature lower than the softening temperature of glass without causing melt-adhesion of titanium oxide particles, which may otherwise occur due to heating to the softening temperature of the glass. Therefore, deformation of glass can be prevented. The softening temperature of glass is typically 500° C. or higher.

In the thus-obtained food container having titanium oxide particles on a surface thereof, the thickness of the thin film formed is usually from 0.005 to 10 μm, more preferably from 0.03 to 0.5 μm. If the thin film thickness is less than 0.005 μm, photocatalytic activity or hydrophilicity may be insufficient, whereas if it exceeds 10 μm, photocatalytic reaction proceeds only in the vicinity of the surface of the titanium oxide thin film and titanium oxide not participating in the photocatalytic reaction increases, which is disadvantageous in view of cost and causes easy peeling off of the thin film from a food container. Furthermore, the transparency of the titanium oxide thin film disadvantageously decreases.

Thus, the food container having titanium oxide particles on a surface thereof decomposes soils attached thereto by the photocatalytic function of titanium oxide particles or kills microorganisms coming into contact and prevents proliferation thereof. The titanium oxide particles have excellent hydrophilicity and the contact angle thereof with water is 20°or less, therefore, the food container is resistant to adsorption of soils such as soil on the outside when the container is used outdoors and soil at the filling port. Even when soiled, the container can be easily washed. The film formed from titanium oxide particles has excellent transparency and does not affect the color of the food container. When the food container is made of glass, the titanium oxide thin film enhances the mechanical strength of the container.

Furthermore, since titanium oxide particles are fixed on a surface of the food container by use of a binder and/or a sintering aid, and as a result, are firmly bonded to the surface, the film has high hardness, is not easily peeled off, and continues with the above-described effects due to the titanium oxide particles over a long period of time. In addition, since titanium oxide particles can be fixed onto the surface of the food container at a temperature as low as 20 to 450° C., the energy cost for heat treatment can be suppressed and thermal deformation of glass forming the food container can be prevented.

Such a food container is used not only outdoors but also indoors and particularly suited for the application to a stainless steel or glass beer barrel which is easy to soil and difficult to wash because of its complicated shape with projections or depressions at a filling port or its shape with large or small complicated curvatures. Beer has components such that water is from 91 to 93 wt %, ethanol is from 3.3 to 3.9 wt %, extract is from 3.1 to 4.0 wt % and carbon dioxide is from 0.42 to 0.55%. Of these components, the extract as a non-volatile organic material contains from 75 to 80 wt % of hydrocarbon comprising sugars such as dextrin. Therefore, out of the beer components, the extract is particularly a main cause of soils.

The soil ascribable to the organic material such as dextrin is degraded by the photocatalytic function of the titanium oxide particles containing brookite crystals, so that soiling is difficult to occur or even when it occurrs, the soil can be easily cleaned.

EXAMPLES

The present invention is described in greater detail below by referring to Examples. Unless otherwise indicated herein, all parts, percents, ratios and the like are by weight.

Example 1

954 ml of distilled water was charged into a glass reaction bath having an internal volume of 1 l with a reflux condenser and heated at 95° C. Then, while stirring the reaction bath at about 200 rpm and maintaining the temperature of liquid within the bath at 95° C., 46 ml of an aqueous titanium tetrachloride solution was added dropwise to the reaction bath at a rate of about 2 ml/min to obtain a solution having a titanium tetrachloride concentration of 0.25 mol/l (2 wt % as titanium oxide). After the completion of dropwise addition, the solution obtained was heated to a temperature in the vicinity of the boiling point (104° C.) and while maintaining the temperature, the titanium tetrachloride was hydrolyzed for 60 minutes. The resulting sol was cooled and condensed and chlorine produced during hydrolysis was removed by electrodialysis using Electrodialyzer Model G3 manufactured by Asahi Chemical Industry Co., Ltd. As a result, a water dispersion titanium oxide sol having a pH of 4.0 (chloride ion: about 400 ppm) was obtained. Particles in the sol were observed under a transmission type electron microscope and found to have a particle size of from 0.01 to 0.03 μm.

In order to examine the crystal structure of the titanium oxide particles contained in the sol, the sol was dried in a vacuum dryer at 60° C. and the titanium oxide particles obtained were analyzed by X-ray diffraction. The X-ray diffraction was performed using an X-ray diffractometer (manufactured by Rigaku Denki K. K. (RAD-B, rotor flex) and the tube bulb used was Cu. Then, a peak indicating the diffraction of the (121) face of brookite crystals was detected at $2\theta=30.8°$. Rutile and anatase were not detected.

In order to apply the thus-obtained water dispersion titanium oxide sol containing brookite titanium oxide, tetramethoxysilane as a binder precursor, which is a silicon-type adhesive, and ethyl alcohol for improving the drying rate were added to prepare a coating material having the composition shown in Table 1 below.

The thus-obtained coating material was applied to a stainless steel beer barrel (volume: 10 l) by a brush coating method, dried at 50° C. for 1 hour in air and then heat-treated at 200° C. for 2 hours in air to obtain a beer barrel having a titanium oxide thin film with a thickness of 0.4 μm on a surface thereof.

On the upper and side surfaces of the resulting beer barrel, 1 l of beer was sprayed by an atomizer and then allowed to stand outdoors for 3 months. Thereafter, the appearance of the beer barrel was visually observed. The evaluation was made based on the soiling at the filling port which had a complicated uneven shape where the soiling was particularly severe. Then, 10 l of a water shower at a temperature of 20° C. was splashed on the beer barrel and the easiness in soil cleaning was visually evaluated. The results obtained are shown in Table 2 below.

Example 2

Titanium tetrachloride was hydrolyzed in the same manner as in Example 1 except that before the dropwise addition of an aqueous titanium tetrachloride solution, phosphoric acid as $Po_4^{3-}$ was added to the reaction tank to a concentration of 200 ppm. Then, a water dispersion titanium oxide sol was obtained in the same manner as in Example 1 except that the pH of the sol obtained above was adjusted to 1.9 (chloride ion: about 600 ppm, phosphate ion: about 200 ppm). Furthermore, particles in the sol were evaluated in the same manner as in Example 1 and found to have a particle size of from 0.01 to 0.03 μm.

The crystal structure of titanium oxide particles contained in the sol was examined in the same manner as in Example 1. As a result, a peak indicating the diffraction of the (121) face of brookite crystals and a peak indicating the diffraction of the (111) face as a main peak of rutile crystals were detected. The main peak of anatase crystals overlaps the main peak of brookite crystals and could not be distinguished, however, a peak indicating the diffraction of the (004) face of anatase crystals was detected. Therefore, the sol obtained was a mixture of brookite crystals, anatase crystals, and rutile crystals. The amount of these crystals were calculated as follows.

Brookite crystal-, anatase crystal-, and rutile crystal-titanium oxides have X-ray diffraction peaks as shown in Table 3 below (extract from JCPDS Card). As seen from d value therein, the peaks overlapped in many parts. In particular, the d values as the main peak of brookite crystals and anatase crystals are 3.51 and 3.52, respectively. Furthermore, the brookite crystals have a peak also at 3.47. These three peaks substantially overlapped.

As such, the intensity ratio in the main peak between the brookite crystals and the anatase crystals cannot be obtained. Therefore, an intensity ratio of the peak where the above-described three peaks overlapped, to the peak of the (121) face of brookite crystals which does not overlap the peak of anatase crystals, namely, (peak intensity of the (121) face of brookite)/(intensity of peak where three peaks overlapped), was obtained. From the value obtained, the amount of brookite titanium oxide and anatase titanium oxide were determined. The amount of rutile titanium oxide was determined from the intensity ratio between the peak indicating the diffraction of the (110) face as the main peak of rutile crystals and the peak where the above-described three peaks overlapped, namely, (main peak intensity of rutile)/(intensity of peak where three peaks overlapped).

As a result, (peak intensity of the (121) face of brookite)/(intensity of peak where three peaks overlapped)=0.38 and (main peak intensity of rutile)/(intensity of peak where three peaks overlapped)=0.05. From these, it was found that about 70 wt % of brookite crystals, about 1.2 wt % of rutile crystals and about 28.8 wt % of anatase crystals were present.

To the thus-obtained water dispersion titanium oxide sol having phosphoric acid added thereto and containing brookite titanium oxide, ethyl alcohol was added to improve the drying rate, thereby preparing a coating material having the composition shown in Table 1 below.

A beer barrel having titanium oxide particles on a surface thereof was produced in the same manner as in Example 1 except for using the coating material obtained above, and evaluated in the same manner. The results are shown in Table 2 below.

Example 3

To a water dispersion titanium oxide sol (specific surface area: about 270 $m^2/g$) containing no brookite crystals and comprising anatase crystals, tetramethoxysilane as a binder precursor, which is a silicon-type adhesive, and ethyl alcohol for improving the drying rate were added to prepare a coating material having the composition shown in Table 1 below.

A beer barrel having titanium oxide particles on a surface thereof was produced in the same manner as in Example 1 except for using the coating material obtained above, and evaluated in the same manner. The results are shown in Table 2 below.

Example 4

To a water dispersion titanium oxide sol (specific surface area: 50 $m^2/g$) containing no brookite crystals and comprising rutile crystals, tetramethoxysilane as a binder precursor, which is a silicon-type adhesive, and ethyl alcohol for improving the drying rate were added to prepare a coating material having the composition shown in Table 1 below.

A beer barrel having titanium oxide particles on a surface thereof was obtained in the same manner as in Example 1 except for using the coating material obtained above, and evaluated in the same manner. The results are shown in Table 2 below.

Example 5

The procedure of Example 1 was repeated except that a glass beer bottle (large bottle: 535 ml) was used instead of a stainless steel beer barrel, to thereby produce a glass beer bottle with titanium oxide particles on a surface thereof. Evaluation was performed in the same manner. The results are shown in Table 2 below.

Furthermore, the strength of the glass beer bottle was tested. For simplifying measurement, a glass plate having the same composition as the beer bottle and a dimension of 5 cm×5 cm×1.2 cm was used. The glass plate was placed on a flat support, and a stainless steel ball having a diameter of 10 mm was freely dropped onto the plate. The height from which the stainless steel ball was dropped was gradually increased, and the height at which the ball was dropped to induce cracking of the glass plate was measured to represent a breakage height. The results are shown in Table 4 below. A higher height indicates a more excellent mechanical strength. The test was carried out five times for each sample, and the maximum height thereof is shown.

Example 6

The procedure of Example 2 was repeated except that a glass beer bottle (large bottle: 535 ml) was used instead of a stainless steel-made beer barrel, to thereby produce a glass-made beer bottle having titanium oxide particles on a surface thereof. Evaluation was performed in the same manner. The results are shown in Table 2.

The strength test for the thus-obtained glass beer bottle was carried out in a manner similar to that described in Example 5. The results are shown in Table 4 below.

Comparative Example 1

An untreated stainless steel beer barrel (volume: 10 l) on which surface titanium oxide particles were not fixed was evaluated in the same manner as in Example 1. The results obtained are shown in Table 2 below.

Comparative Example 2

An untreated glass beer bottle (large bottle: 535 ml) on which surface titanium oxide particles were not fixed was evaluated in the same manner as in Example 1. The results obtained are shown in Table 2 below. The strength test for the thus-obtained glass beer bottle was carried out in a manner similar to that described in Example 5. The results are shown in Table 4 below.

TABLE 1

| Example No. | Titanium Oxide ($TiO_2$) (wt %) | Tetramethoxysilane, as $SiO_2$ (wt %) | Ethyl Alcohol, (wt %) |
|---|---|---|---|
| Example 1 | 2.5 | 0.5 | 75 |
| Example 2 | 2.5 | — | 75 |
| Example 3 | 5.0 | 1.0 | 75 |
| Example 4 | 2.5 | 0.5 | 75 |
| Example 5 | 2.5 | 0.5 | 75 |
| Example 6 | 2.5 | — | 75 |

TABLE 2

| Example No. | Difficulty of Soiling | Easiness of Cleaning |
|---|---|---|
| Example 1 | A | A |
| Example 2 | A | A |
| Example 3 | B | B |
| Example 4 | B | B |
| Example 5 | A | A |
| Example 6 | A | A |
| Comparative Example 1 | C | C |
| Comparative Example 2 | C | C |

In Table 2, each symbol has the following meaning.

(1) Resistance to Soiling

A: almost no soiling

B: slight soiling

C: severe soiling (2) Ease of Soil Removed

A: Soil was easily removed.

B: Soil was not easily removed.

C: Soil was not removed.

TABLE 3

| Extract of JCPDS Card (card No.) | | | | | | | | |
|---|---|---|---|---|---|---|---|---|
| Brookite (29–1360) | | | Anatase (21–1272) | | | Rutile (21–1276) | | |
| d value | Crystal Face | Intensity Ratio | d value | Crystal Face | Intensity Ratio | d value | Crystal Face | Intensity Ratio |
| 3.51 | 120 | 100 | 3.52 | 101 | 100 | 3.25 | 110 | 100 |
| 2.90 | 121 | 90 | 1.89 | 200 | 35 | 1.69 | 221 | 60 |
| 3.47 | 111 | 80 | 2.38 | 004 | 20 | 2.49 | 101 | 50 |

TABLE 4

| Example No. | Breakage height (cm) |
|---|---|
| Example 5 | 30 |
| Example 6 | 30 |
| Comparative Example 2 | 20 |

As shown in Table 2, the beer barrel or beer bottle on which surface titanium oxide particles were fixed was difficult to soil and even when soiled, the soil could be easily removed. This effect was particularly excellent in the case of a beer barrel on which surface titanium oxide particles containing a larger number of brookite crystals were present. In addition, as shown in Table 4, the mechanical strength was also enhanced.

As described in the foregoing, the food container of the present invention is difficult to soil and even when soiled, can be easily washed because of the presence of titanium oxide particles on the surface thereof. Furthermore, when the titanium oxide particles contain brookite crystals, the above-described effect is more excellent.

Unlike a resin coating agent, the titanium oxide film has excellent transparency and accordingly, the container can maintain its original appearance, for example, a container made of a metal such as stainless steel can be a container having a metal gloss and feeling of cleanliness. When the food container of the invention is made of glass, the thickness of a wall of the container can be reduced, since the mechanical strength thereof is also enhanced. Thus, a lightweight glass bottle can be obtained.

For fixing titanium oxide particles on the food container, a sintering aid or binder can be used, therefore, loss of the titanium oxide particles is prevented and the container becomes soil-resistant over a long period of time and even when soiled, can be easily washed. Furthermore, by use of a sintering aid or a binder, titanium oxide particles can be fixed onto a food container without heating at a temperature as high as 500° C. or higher.

While the invention has been described in detail and with reference to specific embodiments thereof, it will be apparent to one skilled in the art that various changes and modifications can be made therein without departing from the spirit and scope thereof.

What is claimed is:

1. A food container comprising a container having titanium dioxide particles on a surface thereof, wherein the titanium dioxide particles are fixed on the surface by use of a sintering aid or both a binder and sintering aid, and wherein the sintering aid is at least one Broensted acid selected from the group consisting of phosphoric acid and an organic carboxylic acid and present in an amount of 10 to 10,000 ppm based on the titanium dioxide and wherein the titanium dioxide particles contain brookite crystals.

2. A food container as claimed in claim 1, wherein the binder is aluminum oxide, zirconium oxide, calcium oxide or magnesium oxide.

3. The food container as in claim 1, wherein the Broensted acid is phosphoric acid.

4. The food container as in claim 1, wherein the Broensted acid is an organic carboxylic acid.

5. The food container as claimed in claim 1, wherein the surface having titanium dioxide particles comprises stainless steel.

6. The food container as claimed in claim 1, wherein the surface having titanium dioxide particles comprises glass.

7. A method for producing a food container comprising fixing titanium dioxide particles on a surface of the container by use of a sintering aid or both a binder and a sintering aid, and wherein the sintering aid is at least one Broensted acid selected from the group consisting of phosphoric acid and an organic carboxylic acid and present in an amount of 10 to 10,000 ppm based on the titanium dioxide and wherein the titanium dioxide particles contain brookite crystals.

8. A method for producing a food container comprising fixing titanium dioxide particles on a surface of the container by use of a sintering aid or both a binder and a sintering aid and fixing the particles at a temperature of 20 to 450° C., and wherein the sintering aid is at least one Broensted acid selected from the group consisting of phosphoric acid and an organic carboxylic acid and present in an amount of 10 to 10,000 ppm based on the titanium dioxide and wherein the titanium dioxide particles contain brookite crystals.

9. The food container as claimed in any one of claims 1, 5 and 5, wherein the titanium dioxide particles are fixed on the surface by use of a binder, a sintering aid or both a binder and a sintering aid and fixed at a temperature of 20 to 450° C.

10. The food container as claimed in any one of claims 1, and 5, wherein the titanium dioxide particles have an average particle size of 0.005 to 0.1 μm.

11. The method according to any one of claim 7 or 8, wherein the Broensted acid is phosphoric acid.

12. The method according to any one of claim 7 or 8, wherein the Broensted acid is an organic carboxylic acid.

* * * * *